US011358192B2

(12) United States Patent
Sposato, Jr. et al.

(10) Patent No.: US 11,358,192 B2
(45) Date of Patent: Jun. 14, 2022

(54) FOLDING ROLLER COMPRISING COATING

(71) Applicant: manroland Goss web systems GmbH, Augsburg (DE)

(72) Inventors: John James Sposato, Jr., Dover, NH (US); David Clarke Pollock, Somersworth, NH (US); David Robert Tuliano, Lee, NH (US)

(73) Assignee: MANROLAND GOSS WEB SYSTEMS GMBH, Augsburg (DE)

( * ) Notice: Subject to any disclaimer, the term of this patent is extended or adjusted under 35 U.S.C. 154(b) by 0 days.

(21) Appl. No.: 17/235,693

(22) Filed: Apr. 20, 2021

(65) Prior Publication Data

US 2021/0331223 A1 Oct. 28, 2021

(51) Int. Cl.
*B21B 27/03* (2006.01)

(52) U.S. Cl.
CPC ..... *B21B 27/03* (2013.01); *B65H 2301/4521* (2013.01)

(58) Field of Classification Search
CPC ..... B65H 2301/452; B65H 2301/4521
See application file for complete search history.

(56) References Cited

U.S. PATENT DOCUMENTS 1,831,250 A 11/1931 Ibell
3,467,009 A 9/1969 Ross
3,767,185 A * 10/1973 Newsome ..... B65H 5/062 271/11
3,773,315 A * 11/1973 Tsien ..... B65B 63/04 493/443
3,788,638 A * 1/1974 Lehmann ..... B65H 27/00 271/272
3,796,423 A * 3/1974 Shuster ..... B65H 27/00 493/421
4,192,497 A * 3/1980 Perun ..... B65H 3/5207 271/121
4,374,212 A * 2/1983 Martellock ..... B65H 3/02 271/10.06

(Continued)

FOREIGN PATENT DOCUMENTS

DE 13 00 023 A 7/1969
DE 21 04 166 B1 8/1972

(Continued)

OTHER PUBLICATIONS

Search Report [German Patent Office (GPO)], English Language Translation, dated Jan. 14, 2021 [Jan. 14, 2021], 5 Pages, Munchen, Germany (DE).

(Continued)

*Primary Examiner* — Jason L Vaughan
(74) *Attorney, Agent, or Firm* — Christopher C. Dremann, P.C.; Christopher C. Dremann

(57) ABSTRACT

A folding roller for folding signatures in a folding apparatus comprises a cylindrical folding roller element comprising a jacket surface at least partially having an elastic coating that is compressible. As such, different folded products and/or folded products of different thicknesses can be produced without a change of the nip between the folding roller pair with consistent folding quality, and an adjustment of the nip is also not required during a production run printing or an ongoing production.

16 Claims, 3 Drawing Sheets

(56) References Cited

U.S. PATENT DOCUMENTS

| | | | | |
|---|---|---|---|---|
| 4,375,971 | A * | 3/1983 | Moll | B65H 27/00 100/176 |
| 4,481,309 | A * | 11/1984 | Straehle | C08G 18/4887 521/172 |
| 5,007,891 | A | 4/1991 | von Hein | |
| 5,076,556 | A * | 12/1991 | Mandel | B65H 45/144 270/45 |
| 5,129,876 | A * | 7/1992 | Brabant | B65H 27/00 492/30 |
| 9,181,385 | B2 * | 11/2015 | Gramellini | C08G 18/4238 |
| 9,682,840 | B2 * | 6/2017 | Echerer | B65H 45/18 |
| 2004/0087754 | A1 * | 5/2004 | Foley | C08G 18/664 528/59 |
| 2004/0157716 | A1 | 8/2004 | Echerer et al. | |
| 2015/0183949 | A1 * | 7/2015 | Xu | C08G 18/4837 428/85 |
| 2015/0336764 | A1 | 11/2015 | Echerer | |

FOREIGN PATENT DOCUMENTS

| | | | |
|---|---|---|---|
| DE | 29 05 548 | A1 | 9/1980 |
| DE | 39 24 970 | A1 | 2/1990 |
| DE | 38 36 342 | A1 | 4/1990 |
| DE | 103 04 534 | A1 | 8/2004 |
| DE | 10 2014 007 495 | A1 | 11/2015 |
| DE | 20 2019 101 582 | U1 | 4/2019 |
| EP | 0 469 867 | A2 | 2/1992 |
| GB | 1040378 | A | 8/1966 |
| JP | S64-34848 | A | 2/1989 |

OTHER PUBLICATIONS

Deutsches Patent—Und Markenamt [German Patent Office (GPO)], Rechercherbericht [Search Report], dated Jan. 18, 2021 [Jan. 18, 2021], 10 Pages, Munchen, Germany (DE).

Europäisches Patentamt [European Patent Office (EPO)], Europäischer Recherchenbericht [European Serach Report], dated Sep. 23, 2021 (Sep. 23, 2021), 11 Pages, Munchen, Germany (DE).

Kopeliovich D, Shore (Durometer) hardness test, Nov. 21, 2009 (Nov. 21, 2009) [Internet Dec. 3, 2010), 2 Pages, SubsTech Substances & Technologies XP-002572960 www.substech.com.

* cited by examiner

FOLDING ROLLER COMPRISING COATING

FIELD OF THE INVENTION

The invention relates to a folding roller for folding signatures in a folding apparatus, wherein the folding roller comprises a cylindrical folding roller element comprising a jacket surface, wherein the jacket surface at least partially has an elastic coating.

The invention furthermore relates to a folding apparatus for forming a fold at a signature to be folded, wherein in the case of the folding apparatus, a signature to be folded is pressed by means of a folding blade into an incoming nip of a counter-rotating folding roller pair in order to form a gap.

The invention moreover relates to a method for operating a folding apparatus, wherein, in order to form a fold at a signature to be folded, the latter is pressed by means of a folding blade into an incoming nip of a counter-rotating folding roller pair, which is spaced apart from one another at an axial distance a, comprising two rollers, each having a roller radius r, wherein at least one of the rollers of the folding roller pair is designed as the above-mentioned folding roller.

RELATED ART AND BACKGROUND OF THE INVENTION

A large variety of folding apparatuses, such as, for example, blade folding or knife folding apparatuses, are known for forming folds at printed or plain signatures, for example in offset, gravure, or inkjet printing presses. Folding apparatuses of this type can either be integrated into a printing press, or they are used to fold the signatures outside of the printing press.

In the case of many folding units, which operate with folding rollers arranged relative to one another in pairs, the folding principle is thereby essentially comparable. In the case of buckle folding units, the leading signature edge essentially runs against a stop, until the signature accumulates, and the resulting curvature is thus seized by a nip and is conveyed transversely to the transport direction of the signature by means of the folding roller pair in order to form a fold.

So-called blade folding or knife folding devices generally consist of a folding table comprising a recess, on which the sheet to be folded comes to rest. To form the fold, the sheet is pressed by a folding blade through the recess of the folding table into the inlet gap of two counter-rotating folding rollers. With their jacket surfaces, the folding rollers seize the sheet and convey the latter into a belt conveyor by forming a fold, which runs parallel to the axis of rotation of the folding rollers. This belt conveyor usually consists of several conveyor belts, which are arranged next to one another at a certain distance and which either wrap around at least one folding roller or are designed independently of the folding rollers.

Folding rollers, which are used in the case of folding devices of this type, are likewise known from the prior art. For instance, DE 38 36 342 A1 discloses a so-called clocked folding roller, which, for example, does not have a continuous cylindrical jacket surface. A folding roller, which has a friction layer on certain portions of the surface, is disclosed in DE 103 04 534 A1.

The folding rollers known from the prior art have a more or less easy-to-grip jacket surface for seizing and for transporting the signature through the nip, even though the jacket surface of the folding rollers is relatively hard for the most part.

However, jacket surfaces, which are so hard, of folding rollers have the disadvantage that the nip has to be adapted to the thickness of the substrate of the signature as well as to the page number, the thickness of the signature to be folded, etc.

Setting processes of this type take place manually for the most part, require corresponding experience of the operating personnel, and, in addition to an additional time expenditure, also represent an additional error source. In the case of a nip, which is set too narrowly, the signature to be folded can thus either no longer be conveyed through the counter-rotating folding roller pair and causes a stopper, or the folded product is crimped too much and is damaged thereby. In contrast, a nip, which is set too widely, between the folding rollers, can also lead to a stopper or to a carelessly executed fold.

It should furthermore be noted that due to the fluctuating substrate thicknesses during the production run printing or during a production, the setting of the nip can also be required during the ongoing production, which increases the risk of stoppers and/or of additionally arising paper waste.

In particular in the case of signatures, which are relatively thick and/or which already have at least one fold, the folding rollers known from the prior art do not mandatorily have to be set parallel to one another, on the contrary, the two axes of rotation have to have a suitable angle relative to one another in order to form a clean fold on the one hand and in order to avoid crimped folds on the other hand.

OBJECT AND SUMMARY OF THE INVENTION

The invention is thus based on the object of creating a solution, by means of which different folded products and/or folded products of different thicknesses can be produced without a change of the nip between the folding roller pair with consistent folding quality, and an adjustment of the nip is thus also not required during the production run printing or the ongoing production.

This object is solved by means of a folding roller according to the invention as shown and described herein. The folding roller comprises a coating, in the case of which an elastic coating is compressible.

The invention further comprises a folding apparatus, in the case of which at least one roller of a counter-rotating folding roller pair is embodied as a folding roller comprising an elastic and compressible coating.

The invention furthermore comprises a method for operating a folding apparatus, wherein, the two rollers of the folding roller pair are placed against one another in such a way that the axial distance a is set to be identical to or smaller than the sum of the roller radii r.

Based on a folding roller comprising an elastic and compressible coating, embodiments of this type have the advantage that the effective nip adapts to the respective printing product, independently of the substrate thickness and/or page number thereof, by means of the elastic and simultaneously compressible coating, so that the distance of the folding rollers relative to one another, and thus the nip does not or does not mandatorily need to be changed prior to a new production as well as during a production.

However, should a change of the nip be required nonetheless due to the production of signatures to be folded, which have very different thicknesses, for example due to highly varying page numbers and/or highly varying substrate thicknesses, the setting of the nip can take place within a large tolerance range and is thus much less critical, because changes to the signature thickness can be compensated to a high degree due to the elastic and compressible coating of at least one folding roller.

Thickness fluctuations within the signature, usually caused by already existing folds of the signature, which is to be folded once again, can further also be compensated by means of the compressibility of the coating, whereby, for example, the setting of a suitable angle between the axes of rotation of the folding rollers is avoided.

The compressibility of the coating is thereby significant, because, compared to elastic and incompressible coatings, the formation of a bead at the nip is thereby ruled out. Beads of this type make it more difficult or prevent that the signature is seized by the nip and is pulled into the nip in a secure manner. In the case of an elastic and incompressible coating, an uneven speed profile within the nip is moreover created due to the bead formation, whereby damages to the signature to be folded are created or—in the case of multi-layer signatures to be folded—the individual layers can be shifted relative to one another, which leads to an unsatisfactory product quality as a whole.

According to an advantageous embodiment of the invention, the coating consists of foamed polyurethane. Polyurethane has a very high fatigue strength and wear resistance, and thus ensures a long service life of the coating.

In a further advantageous embodiment of the invention, the coating consists of microcellular polyurethane, because the latter has even higher strength and damping properties.

Preferred further embodiments of the invention follow from the following description. Various exemplary embodiments of the invention will be described in more detail based on the drawings, without being limited thereto.

BRIEF DESCRIPTION OF THE DRAWING FIGURES

DETAILED DESCRIPTION OF EXEMPLARY EMBODIMENTS

The present invention relates to a folding roller for folding signatures in a folding apparatus, wherein the folding roller comprises a cylindrical folding roller element comprising a jacket surface, wherein the jacket surface at least partially has an elastic coating.

Figure 1:
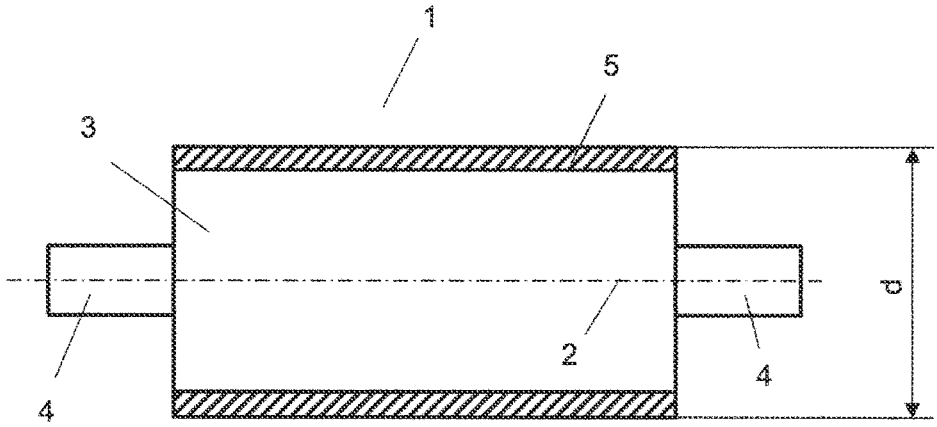
FIG. 1 shows a general setup of a coated folding roller.

The general setup of a folding roller 1 according to the invention is shown in FIG. 1. A folding roller 1 rotates around an axis of rotation 2 and comprises essentially a cylindrical folding roller element 3, which has a jacket surface, by means of which the signature to be folded is seized and which also forms the fold to be created. At both ends, the folding roller 1 generally further in each case comprises a roller journal 4, to which the bearings, which are not shown in FIG. 1 for purposes of clarity, are applied. These bearings usually sit in folding roller levers (likewise not shown for purposes of clarity), so that each folding roller 1 is supported so as to be rotatable around its axis of rotation 2, so that the distance of the folding rollers 1 of the folding roller pair 14 (FIGS. 3-5) can be changed. An elastic coating 5 is at least partially applied to the jacket surface of the folding roller element 3, whereby the elastic coating 5 is compressible.

The jacket surface of the folding roller element 3 can completely have a coating 5, as illustrated, for example, in FIG. 1. It is also possible, however, that no coating 5 is applied to the jacket surface in certain areas in the axial extension of the axis of rotation 2, so that the belt conveyor 16 shown in FIG. 4, for example, can run directly on the folding roller element 3 in these uncoated areas.

It is also possible, however, that the coating 5 is applied to the jacket surface of the folding roller element 3 only in certain areas in the circumferential direction, for example only in the areas in the circumferential direction comparable to clocked folding rollers 1, by means of which the signature to be folded is seized from the jacket surface and is folded away.

Figure 3:
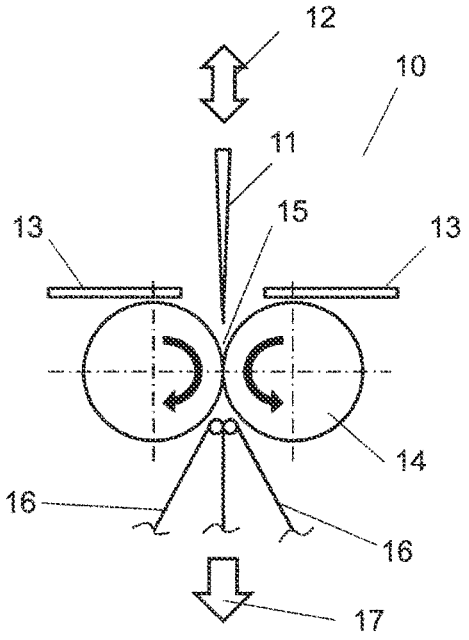
FIG. 3 shows a folding apparatus comprising a folding blade and a belt conveyor below the folding rollers.
Figure 4:
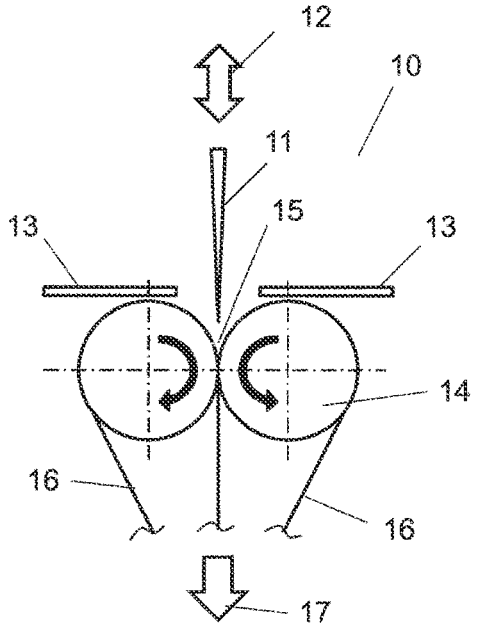
FIG. 4 shows a folding apparatus comprising a folding blade and a belt conveyor wrapping around the folding rollers.

In an advantageous embodiment of the invention, the elastic, compressible coating 5 of the jacket surface of the folding roller element 3 consists of foamed polyurethane or of microcellular polyurethane. As elastic polymer, polyurethane is suitable for fields of application of this type due to its high strength and resistance, the compressibility of the coating 5 is ensured by means of the design of the coating 5 as foamed or microcellular polyurethane in order to avoid a bead formation in the nip 15 (FIG. 3 and FIG. 4).

Figure 2:
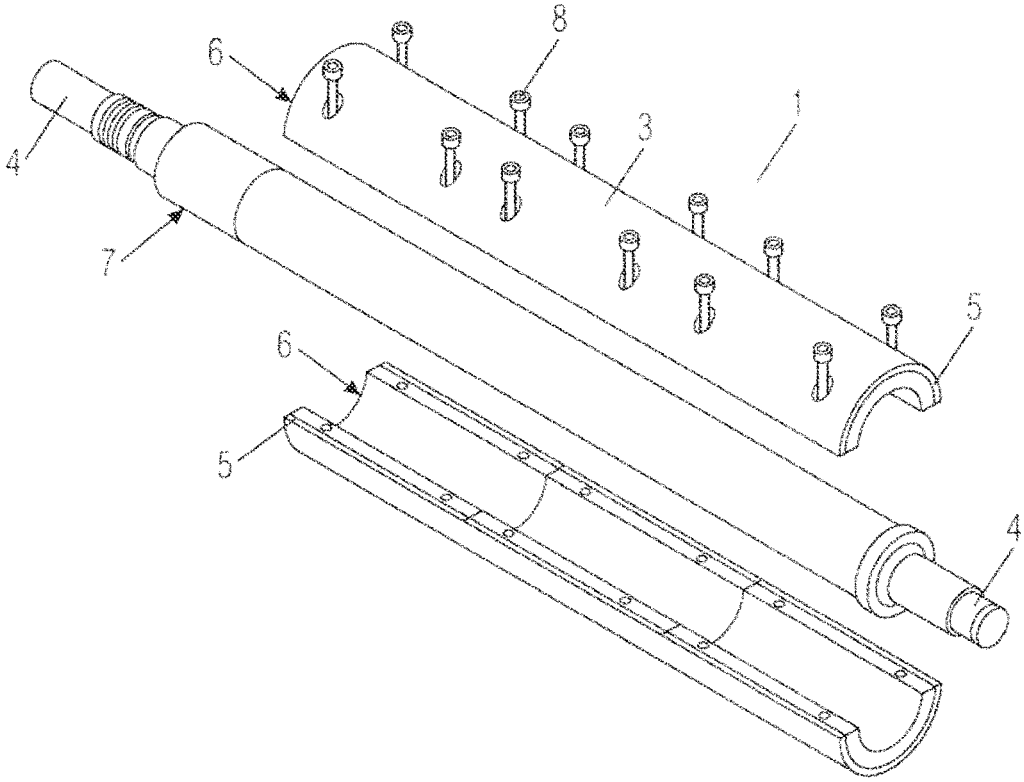
FIG. 2 shows a folding roller comprising a plurality of shell-shaped segments.

FIG. 2 shows an alternative embodiment of a folding roller 1 according to the invention. In the case of this embodiment, the folding roller element 3 is not a rigid and unchangeable part of the folding roller 1, as illustrated in FIG. 1, on the contrary, the folding roller element 3 comprises a plurality of shell-shaped segments 6, which can be joined together, in the case of the folding roller 1 illustrated in FIG. 2, whereby an elastic and compressible coating 5 is applied to at least a portion of the jacket surface formed by means of the shell-shaped segments 6.

In the case of the example illustrated in FIG. 2, the folding roller element 3 consists of two half shell-shaped segments 6, which extend over the entire length of the folding roller element 3 and which are clamped against one another as well as onto the shaft 7 of the folding roller 1 by connecting elements 8, which are formed, for example, as screws. Even though not illustrated in FIG. 2, it is also possible to arrange a plurality of shell-shaped segments 6 next to one another in the axial extension of the folding roller element 3. It is also generally possible to arrange more than two segments 6 in the circumferential direction of the folding roller element 3.

Due to the design of the folding roller element 3 as a plurality of segments 6, which can be joined together, it is thus possible to replace the segments 6, which are at least partially coated with the coating 5, and thus the coating 5, in the case of wear, without the folding roller 1 as a whole and thus the roller journals 4 having to be disassembled from the non-illustrated support.

In the case of the folding rollers 1 illustrated in FIG. and FIG. 2, the coating 5 has a thickness of about 3 millimeters to about 30 millimeters in the radial extension. In a particularly preferred embodiment, the coating 5 has a thickness of about 10 millimeters to about 20 millimeters in the radial extension.

The coating 5 further consists of an elastic, compressible material with a Shore hardness of about 20 Shore D to about 80 Shore D, wherein, in a particularly advantageous embodiment, the hardness of the coating 5 preferably lies in a range of about 40 Shore D to about 70 Shore D.

FIG. 3 shows a folding apparatus 10, in the case of which the folding roller 1 according to the invention is used in an exemplary manner, and by means of which a fold can be formed at a signature to be folded, which is not shown for purposes of clarity.

The signature to be folded is usually transported on the folding table 13 in the direction perpendicular to the drawing plane into the folding apparatus 10, and is slowed down at least by means of a sheet stop (likewise not shown for purposes of clarity), and is thus positioned in a defined position on the folding table 13.

The folding apparatus 10 further comprises a folding roller pair 14 of counter-rotating rollers, wherein at least one roller of the counter-rotating folding roller pair 14 is formed as a folding roller 1 according to the invention. In an advantageous embodiment, both rollers of the folding roller pair 14 are embodied as folding roller 1 according to the invention comprising an elastic and compressible coating 5. If only one roller of the folding roller pair 14 is embodied as folding roller 1 according to the invention, the other roller is embodied with a hard folding roller element 3.

The two counter-rotating rollers of the folding roller pair 14 form a nip 15, into which the signature to be folded is drawn due to the direction of rotation.

The folding apparatus 10 furthermore comprises a folding blade 11, which performs a direction of movement 12 essentially perpendicular to the plane spanned by the folding table 13, at least at the point in time at which the folding blade 11 presses the signature to be folded into the nip 15. The folding blade 11 can either be embodied as a rocker, can be arranged in a rotating folding drum, or can be driven by means of other mechanisms, such as, for example, a crank drive.

By pressing the signature to be folded into the nip 15, the signature is seized by the folding roller pair 14 and is pulled through the nip 15 for the formation of or by forming a fold, respectively.

The signature folded by means of the folding roller pair 14 is further transported by means of the direction of rotation of the folding roller pair 14 and is guided into a belt conveyor 16, so that the signature is guided out of the folding apparatus 10 in the transport direction 17 by means of the belt conveyor 16.

FIG. 3 thereby shows a folding apparatus 10, in the case of which the belt conveyor 16, which serves to receive the folded signature, is arranged below the counter-rotating folding roller pair 14.

FIG. 4 shows a folding apparatus 10, which is essentially identical to the folding apparatus 10 shown in FIG. 3. The difference between the folding apparatus 10 illustrated in FIG. 3 and the folding apparatus 10 illustrated in FIG. 4 is that the folding apparatus 10 shown in FIG. 4 comprises a belt conveyor 16, in the case of which the belt conveyor 16 partially wraps around both rollers of the folding roller pair 14, so that the signature to be folded is guided directly into the belt conveyor 16 by being seized by the nip 15.

At the locations where the belt conveyor 16 wraps around the folding rollers 1, the compressible coating 5 can either have a groove, or no coating 5 is applied to the jacket surface of the folding roller element 3 at these areas.

Although not illustrated in the figures, a combination of the alternative embodiments illustrated in FIG. 3 and FIG. 4 is also possible, so that a first roller of the folding roller 14 is at least partially wrapped by a belt conveyor 16, while the other portion of the belt conveyor 16 is arranged below the second roller of the folding roller pair 14. It is irrelevant thereby whether the first roller and/or the second roller of the folding roller pair 14 as folding roller 1 according to the invention is embodied with elastic, compressible coating 5.

Figure 5:
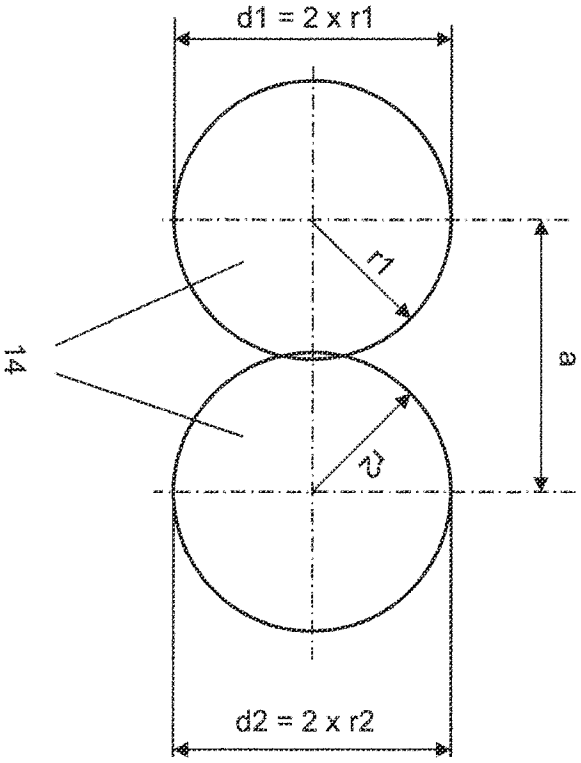
FIG. 5 shows a detail view of a folding roller pair in which an axial distance between the folding roller pair is identical to or smaller than the sum of the radii of the folding roller pair.

FIG. 5 shows a detail view of a folding roller pair 14 from FIG. 3 or FIG. 4. In the case of the folding roller pair 14 illustrated in FIG. 5, either only one of the two rollers or also both rollers of the folding roller pair 14 can be embodied as a folding roller 1 according to the invention comprising elastic and compressible coating 5. In a preferred embodiment, both rollers of the folding roller pair 14 are embodied as folding roller 1 according to the invention comprising elastic and compressible coating 5.

As can be seen from FIG. 3 and FIG. 4, the two rollers of the folding roller pair 14 rotate opposite to one another during operation, but the arrows of the rotational movements are not illustrated in FIG. 5 for purposes of clarity.

In the normal state, when not under compressive stress, the first roller of the folding roller pair 14 has a first roller radius r1. In the normal state, when not under compressive stress, the second roller of the folding roller pair likewise has a second roller radius r2. The first roller diameter d1 of the first roller is twice the first roller radius r1, the second roller diameter d2 of the second roller is twice the second roller radius r2.

In the case of the folding roller pairs 14 known from the prior art comprising a relatively hard jacket surface of the folding roller element 3, a gap remains between the first and the second roller of the folding roller pair 14 in the case of a setting, which is suitable for the production, to avoid stoppers or product damages, such as crimped folds, etc., so that in the case of folding roller pairs 14, which are known from the prior art, the distance of the two axes of rotation 2 is larger than the sum of the first roller radius r1 and of the second roller radius r2.

Due to the elastic and compressible coating 5 according to the invention of at least one folding roller 1 of the folding roller pair 14, however, it is also possible to set the two rollers of the folding roller pair 14 relative to one another in such a way that an axial distance a, that is, the distance between the two axes of rotation 2 of the two rollers of the folding roller pair 14, is identical to or smaller than the sum of the first roller radius r1 and of the second roller radius r2, and thus identical to or smaller than the sum of the roller radii r1, r2.

A setting is illustrated in FIG. 5, in which the axial distance a is smaller than the sum of the roller radii r1, r2, so that an overlap of the jacket surfaces results graphically. It goes without saying that, in reality, this overlap does not result, in fact, a flattening of the jacket surface of the at least one elastic and compressible coating 5 takes place in the contact zone. It is to in fact be clarified by means of this illustration that the axial distance a can also be smaller than the sum of the roller radii r1, r2.

In the case of a setting of this type, a nip 15 is thus created, into which a signature to be folded is drawn in any case, which means a high operational safety. Signatures to be folded of different thicknesses can be compensated by means of the compressibility of the coating 5.

In a particularly preferred embodiment, the axial distance a of the folding roller pair 14 can be set in such a way that the axial distance a is about 0.1 millimeter to about 5 millimeters smaller than the sum of the roller radii r1, r2. In the case of this setting, a constant compression between the rollers of the folding roller pair 14 is ensured, without creating an excessive compression, and so as to thus be able to seize and to fold signatures to be folded of a smaller or larger thickness therewith.

Regardless of whether the axial distance a is identical to or smaller than the sum of the roller radii r1, r2, the axial distance a can be kept constant in the case of a changing signature thickness due to the compressibility of the coating 5 of a folding roller 1 according to the invention. On the one hand, this applies for set-up processes, which are thus no longer required, in response to a production change as well as, on the other hand, for changes to the folding roller setting, which are thus no longer required, during an ongoing production.

That which is claimed is:

1. A folding roller of a folding roller pair for folding signatures in a folding apparatus having a folding blade for pressing the signatures into a nip between the folding roller pair, wherein the folding roller comprises a cylindrical folding roller element comprising a plurality of segments having a jacket surface that are joined together in a circumferential direction, wherein the jacket surface of at least one of the plurality of segments at least partially has an elastic coating that is compressible.

2. The folding roller according to claim 1, wherein the coating consists of foamed polyurethane.

3. The folding roller according to claim 1, wherein the coating consists of microcellular polyurethane.

4. The folding roller according to claim 1, wherein the coating has a thickness of from about 3 mm to about 30 mm.

5. The folding roller according to claim 4, wherein the coating has a thickness of from about 10 mm to about 20 mm.

6. The folding roller according to claim 1, wherein the coating has a hardness of from about 20 to about 80 Shore D.

7. The folding roller according to claim 6, wherein the coating has a hardness from about 40 to about 70 Shore D.

8. A folding apparatus for forming a fold at a signature to be folded, wherein the signature to be folded is pressed by means of a folding blade into an incoming nip of a counter-rotating folding roller pair, wherein at least one folding roller of the folding roller pair is a folding roller comprising a jacket surface at least partially having an elastic coating that is compressible, wherein each folding roller of the folding roller pair defines an axis of rotation and a first folding roller of the folding roller pair defines a first roller radius and a second folding roller of the folding roller pair defines a second roller radius, and wherein an axial distance between the axis of rotation of the first folding roller and the axis of rotation of the second folding roller is equal to or greater than the sum of the first roller radius and the second roller radius when the coating is not compressed and is less than the sum of the first roller radius and the second roller radius when the coating is compressed.

9. The folding apparatus according to claim 8, wherein at least one belt conveyor, which serves to receive the folded signature, is arranged below the counter-rotating folding roller pair.

10. The folding apparatus according to claim 8, wherein at least one belt conveyor, which serves to receive the folded signature, wraps around at least one folding roller of the folding roller pair.

11. The folding apparatus according to claim 8, wherein the axial distance between the axis of rotation of the first folding roller and the axis of rotation of the second folding roller is set to be identical to or smaller than the sum of the first roller radius and the second roller radius.

12. The folding apparatus according to claim 11, wherein the axial distance is about 0.1 to about 5 mm smaller-than the sum of the first roller radius and the second roller radius.

13. A folding apparatus for forming a fold at a signature to be folded, wherein the signature to be folded is pressed by means of a folding blade into an incoming nip of a counter-rotating folding roller pair, wherein at least one folding roller of the folding roller pair is a cylindrical folding roller comprising a plurality of segments disposed in a circumferential direction, and wherein at least one folding roller of the folding roller pair comprises a jacket surface that at least partially having an elastic coating that is compressible.

14. A method for operating a folding apparatus, wherein to form a fold at a signature to be folded, the signature is pressed by means of a folding blade into an incoming nip of a counter-rotating folding roller pair having axes of rotation and spaced apart at an axial distance between the axes of rotation, comprising providing two folding rollers having roller radii, wherein at least one of the folding rollers of the folding roller pair comprises a jacket surface at least partially having an elastic coating that is compressible, and placing the two folding rollers of the folding roller pair such that the axial distance between the axes of rotation is equal to or greater than the sum of the roller radii when the coating is not compressed and is less than the sum of the roller radii when the coating is compressed.

15. The method according to claim 14, wherein the axial distance between the axes of rotation of the folding roller pair is set such that the axial distance is set to be about 0.1 to about 5 mm less than the sum of the roller radii.

16. The method according to claim 14, wherein the axial distance between the axes of rotation of the folding roller pair is kept constant in the case of a changing signature thickness.

* * * * *